US005713793A

United States Patent [19]

Holte

[11] Patent Number: 5,713,793

[45] Date of Patent: Feb. 3, 1998

[54] SPORTING EVENT OPTIONS MARKET TRADING GAME

[75] Inventor: Keenan O. Holte, Tempe, Ariz.

[73] Assignee: Oris, L.L.C., Chandler, Ariz.

[21] Appl. No.: 628,297

[22] Filed: Apr. 5, 1996

[51] Int. Cl.[6] ..... A63F 9/00

[52] U.S. Cl. ..... 463/25; 463/1; 463/9; 463/42

[58] Field of Search ..... 463/42, 41, 40, 463/25, 9, 1, 22; 434/107; 273/278, 297; 364/410, 412

[56] References Cited

U.S. PATENT DOCUMENTS

| | | | |
|---|---|---|---|
| 3,770,277 | 11/1973 | Cass | 273/135 |
| 4,010,957 | 3/1977 | Tricoli | 273/134 |
| 4,082,278 | 4/1978 | Bolton | 273/94 |
| 4,378,942 | 4/1983 | Isaac | 273/278 |
| 4,592,546 | 6/1986 | Fascenda et al. | 463/40 |
| 4,856,788 | 8/1989 | Fischel | 273/256 |
| 4,934,707 | 6/1990 | Koster | 273/240 |
| 4,948,145 | 8/1990 | Breslow | 273/256 |
| 4,991,853 | 2/1991 | Lott | 273/242 |
| 5,013,038 | 5/1991 | Luxenberg et al. | 463/42 |
| 5,018,736 | 5/1991 | Pearson et al. | 463/1 |
| 5,090,735 | 2/1992 | Meaney et al. | 283/67 |
| 5,092,596 | 3/1992 | Bucaria | 273/297 |
| 5,102,143 | 4/1992 | Winkelman | 273/240 |
| 5,139,269 | 8/1992 | Peterson | 273/256 |
| 5,332,218 | 7/1994 | Lucey | 463/41 |
| 5,564,701 | 10/1996 | Dettor | 273/278 |

OTHER PUBLICATIONS

"Rotisserie Baseball", Pitts, Mark, Washington Post, Weekend Section, pp. 9–11, Apr. 26, 1991.

*Primary Examiner*—Jessica Harrison
*Assistant Examiner*—James Schaaf
*Attorney, Agent, or Firm*—O'Connor, Cavanagh; John D. Titus

[57] ABSTRACT

A commodities options trading game is provided in which the simulated market, which determines whether the value of the simulated commodities options rise or fall, is determined by a real event occurring outside the game being played. In a preferred embodiment, the event from which the simulated market is derived is a real-life sporting event, such as a professional basketball, football, or baseball game. Preferably a host calculator or computer generates the initial option prices and displays the information to a plurality of player stations. After play begins, the host computer updates the options prices using formula based on the current score, time remaining and a other empirically determined factors. The players buy and sell options in response to the momentum of the market. At the conclusion of the sporting event, the options are cashed in for their intrinsic value and the player with the most accumulated wealth is declared the winner.

20 Claims, 15 Drawing Sheets

FIG. 3

SCREEN PRINT #1
INPUTS :

| | |
|---|---|
| FAVORITE'S SCORE | 0 |
| UNDERDOG'S SCORE | 0 |
| MINUTES LEFT | 48 |
| POINT SPREAD | 5 |
| SET OVER UNDER | 200 |

| | | | | | | | | | |
|---|---|---|---|---|---|---|---|---|---|
| FAVORITE'S OPTIONS: | LOSE UNDER 12 OR WIN | LOSE UNDER 9 OR WIN | LOSE UNDER 6 OR WIN | LOSE UNDER 3 OR WIN | WIN BY 1 OR MORE | WIN BY MORE THAN 3 | WIN BY MORE THAN 6 | WIN BY MORE THAN 9 | WIN BY MORE THAN 12 |
| 40 STRIKE PRICE | 88 | 91 | 94 | 97 | 100 | 103 | 106 | 109 | 112 |
| EXPLANATION OF FORMULA TO CALCULATE INDEX | FAVORITE'S SCORE MINUS UNDERDOG'S SCORE PLUS 100 (EXPLANATION IS SAME FOR ALL STRIKE PRICES) | | | | | | | | |
| 42 RESULT OF INDEX CALCULATION | 100 | 100 | 100 | 100 | 100 | 100 | 100 | 100 | 100 |
| EXPLANATION OF IN/OUT OF THE MONEY | STRIKE PRICE MINUS THE INDEX ( EXPLANATION IS THE SAME FOR ALL STRIKE PRICES) | | | | | | | | |
| 44 RESULT OF IN/OUT OF MONEY FORMULA | -12 | -9 | -6 | -3 | 0 | 3 | 6 | 9 | 12 |
| EXPLANATION OF FORMULA TO CALCULATE TIME DECAY ON POINT SPREAD | POINT SPREAD MULTIPLIED BY MINUTES LEFT DIVIDED BY TOTAL MINUTES IN PRO BASKETBALL GAME WHICH IS 48 (SAME FOR ALL STRIKE) | | | | | | | | |
| 46 RESULT OF TIME DECAY ON POINT SPREAD | 5 | 5 | 5 | 5 | 5 | 5 | 5 | 5 | 5 |
| EXPLANATION OF ACCURACY FACTOR FORMULA | RESULT OF TIME DECAY ON POINT SPREAD MULTIPLIED BY RESULT OF INDEX CALCULATION MULTIPLIED BY .01 (SAME FOR ALL STRIKE) | | | | | | | | |
| 48 RESULT OF ACCURACY FACTOR FORMULA | 5 | 5 | 5 | 5 | 5 | 5 | 5 | 5 | 5 |
| 49 EXPLANATION OF FINAL PRICE CALCULATION | (EXPLANATION IS SAME FOR ALL STRIKE PRICES)<br>IF RESULT OF IN/OUT IS EQUAL TO OR LESS THAN ZERO THEN TAKE RESULT OF INDEX MINUS STRIKE PRICE PLUS RESULT OF TIME DECAY ON POINT SPREAD<br>IF RESULT OF IN/OUT OF MONEY IS GREATER THAN ZERO AND LESS THAN OR EQUAL TO 2 TAKE RESULT OF ACCURACY FACTOR FORMULA MULTIPLIED BY .8<br>IF RESULT OF IN/OUT OF MONEY IS GREATER THAN 2 AND LESS THAN OR EQUAL TO 5 TAKE RESULT OF ACCURACY FACTOR FORMULA MULTIPLIED BY .6<br>IF RESULT OF IN/OUT OF MONEY IS GREATER THAN 5 AND LESS THAN OR EQUAL TO 8 TAKE RESULT OF ACCURACY FACTOR FORMULA MULTIPLIED BY .35<br>IF RESULT OF IN/OUT OF MONEY IS GREATER THAN 8 AND LESS THAN OR EQUAL TO 11 TAKE RESULT OF ACCURACY FACTOR FORMULA MULTIPLIED BY .15<br>IF RESULT OF IN/OUT OF MONEY IS GREATER THAN 11 AND LESS THAN OR EQUAL TO 14 TAKE RESULT OF ACCURACY FACTOR FORMULA MULTIPLIED BY .05<br>IF RESULT OF IN/OUT OF MONEY IS GREATER THAN 14 MAKE THE RESULT EQUAL .1 AND MAKE ALL HIGHER STRIKE PRICES EQUAL ZERO | | | | | | | | |
| RESULT IS CURRENT PRICE (ROUNDED) | 17.0 | 14.0 | 11.0 | 8.0 | 5.0 | 3.0 | 1.8 | 0.8 | 0.3 |

FIG. 4

SCREEN PRINT #1

INPUTS :

| | |
|---|---|
| FAVORITE'S SCORE | 0 |
| UNDERDOG'S SCORE | 0 |
| MINUTES LEFT | 48 |
| POINT SPREAD | 5 |
| SET OVER UNDER | 200 |

| | | | | | | | | | |
|---|---|---|---|---|---|---|---|---|---|
| UNDERDOG'S OPTION: | WIN BY MORE THAN 12 | WIN BY MORE THAN 9 | WIN BY MORE THAN 6 | WIN BY MORE THAN 3 | WIN BY 1 OR MORE | LOSE UNDER 3 OR WIN | LOSE UNDER 6 OR WIN | LOSE UNDER 9 OR WIN | LOSE UNDER 12 OR WIN |
| 50 STRIKE PRICE | 88 | 91 | 94 | 97 | 100 | 103 | 106 | 109 | 112 |
| EXPLANATION OF FORMULA TO CALCULATE INDEX | FAVORITE'S SCORE MINUS UNDERDOG'S SCORE PLUS 100 (EXPLANATION IS SAME FOR ALL STRIKE PRICES) | | | | | | | | |
| 52 RESULT OF INDEX CALCULATION | 100 | 100 | 100 | 100 | 100 | 100 | 100 | 100 | 100 |
| EXPLANATION OF IN/OUT OF THE MONEY | INDEX MINUS THE STRIKE PRICE (EXPLANATION IS THE SAME FOR ALL STRIKE PRICES) | | | | | | | | |
| 54 RESULT OF IN/OUT OF MONEY FORMULA | 12 | 9 | 6 | 3 | 0 | -3 | -6 | -9 | -12 |
| EXPLANATION OF FORMULA TO CALCULATE TIME DECAY ON POINT SPREAD | MINUTES LEFT DIVIDED BY TOTAL MINUTES IN PRO BASKETBALL GAME WHICH IS 48 (SAME FOR ALL STRIKE) | | | | | | | | |
| 56 RESULT OF TIME DECAY ON POINT SPREAD | 1 | 1 | 1 | 1 | 1 | 1 | 1 | 1 | 1 |
| EXPLANATION OF ACCURACY FACTOR FORMULA | RESULT OF TIME DECAY ON POINT SPREAD MULTIPLIED BY RESULT OF INDEX CALCULATION MULTIPLIED BY .01 (SAME FOR ALL STRIKE) | | | | | | | | |
| 58 RESULT OF ACCURACY FACTOR FORMULA | 1 | 1 | 1 | 1 | 1 | 1 | 1 | 1 | 1 |
| 59 EXPLANATION OF FINAL PRICE CALCULATION | (EXPLANATION IS SAME FOR ALL STRIKE PRICES)<br>IF RESULT OF IN/OUT IS EQUAL TO OR LESS THAN ZERO THEN TAKE RESULT OF STRIKE PRICE MINUS INDEX PLUS RESULT OF TIME DECAY ON POINT SPREAD<br>IF RESULT OF IN/OUT OF MONEY IS GREATER THAN ZERO AND LESS THAN OR EQUAL TO 2 TAKE RESULT OF ACCURACY FACTOR FORMULA MULTIPLIED BY .7<br>IF RESULT OF IN/OUT OF MONEY IS GREATER THAN 2 AND LESS THAN OR EQUAL TO 5 TAKE RESULT OF ACCURACY FACTOR FORMULA MULTIPLIED BY .5<br>IF RESULT OF IN/OUT OF MONEY IS GREATER THAN 5 AND LESS THAN OR EQUAL TO 8 TAKE RESULT OF ACCURACY FACTOR FORMULA MULTIPLIED BY .3<br>IF RESULT OF IN/OUT OF MONEY IS GREATER THAN 8 AND LESS THAN OR EQUAL TO 11 TAKE RESULT OF ACCURACY FACTOR FORMULA MULTIPLIED BY .1<br>IF RESULT OF IN/OUT OF MONEY IS GREATER THAN 11 AND LESS THAN OR EQUAL TO 14 TAKE RESULT OF ACCURACY FACTOR FORMULA MULTIPLIED BY .03<br>IF RESULT OF IN/OUT OF MONEY IS GREATER THAN 14 MAKE THE RESULT EQUAL .1 AND MAKE ALL HIGHER STRIKE PRICES EQUAL ZERO | | | | | | | | |
| RESULT IS CURRENT PRICE (ROUNDED) | 0.0 | 0.1 | 0.3 | 0.5 | 1.0 | 4.0 | 7.0 | 10.0 | 13.0 |

FIG. 6

SCREEN PRINT #7

INPUTS :

| | |
|---|---|
| FAVORITE'S SCORE | 70 |
| UNDERDOG'S SCORE | 75 |
| MINUTES LEFT | 16 |
| POINT SPREAD | 5 |
| SET OVER UNDER | 200 |

| FAVORITE'S OPTIONS: | LOSE UNDER 12 OR WIN | LOSE UNDER 9 OR WIN | LOSE UNDER 6 OR WIN | LOSE UNDER 3 OR WIN | WIN BY 1 OR MORE | WIN BY MORE THAN 3 | WIN BY MORE THAN 6 | WIN BY MORE THAN 9 | WIN BY MORE THAN 12 |
|---|---|---|---|---|---|---|---|---|---|
| STRIKE PRICE | 88 | 91 | 94 | 97 | 100 | 103 | 106 | 109 | 112 |
| EXPLANATION OF FORMULA TO CALCULATE INDEX | FAVORITE'S SCORE MINUS UNDERDOG'S SCORE PLUS 100 (EXPLANATION IS SAME FOR ALL STRIKE PRICES) | | | | | | | | |
| 42 RESULT OF INDEX CALCULATION | 95 | 95 | 95 | 95 | 95 | 95 | 95 | 95 | 95 |
| EXPLANATION OF IN/OUT OF THE MONEY | STRIKE PRICE MINUS THE INDEX (EXPLANATION IS THE SAME FOR ALL STRIKE PRICES) | | | | | | | | |
| RESULT OF IN/OUT OF MONEY FORMULA | -7 | -4 | -1 | 2 | 5 | 8 | 11 | 14 | 17 |
| EXPLANATION OF FORMULA TO CALCULATE TIME DECAY ON POINT SPREAD | POINT SPREAD MULTIPLIED BY MINUTES LEFT DIVIDED BY TOTAL MINUTES IN PRO BASKETBALL GAME WHICH IS 48 (SAME FOR ALL STRIKE) | | | | | | | | |
| RESULT OF TIME DECAY ON POINT SPREAD | 1.666666667 | 1.666666667 | 1.666666667 | 1.666666667 | 1.666666667 | 1.666666667 | 1.666666667 | 1.666666667 | 1.666666667 |
| EXPLANATION OF ACCURACY FACTOR FORMULA | RESULT OF TIME DECAY ON POINT SPREAD MULTIPLIED BY RESULT OF INDEX CALCULATION MULTIPLIED BY .01 (SAME FOR ALL STRIKE) | | | | | | | | |
| RESULT OF ACCURACY FACTOR FORMULA | 1.583333333 | 1.583333333 | 1.583333333 | 1.583333333 | 1.583333333 | 1.583333333 | 1.583333333 | 1.583333333 | 1.583333333 |
| EXPLANATION OF FINAL PRICE CALCULATION | (EXPLANATION IS SAME FOR ALL STRIKE PRICES)<br>IF RESULT OF IN/OUT IS EQUAL TO OR LESS THAN ZERO THEN TAKE RESULT OF INDEX MINUS STRIKE PRICE PLUS RESULT OF TIME DECAY ON POINT SPREAD<br>IF RESULT OF IN/OUT OF MONEY IS GREATER THAN ZERO AND LESS THAN OR EQUAL TO 2 TAKE RESULT OF ACCURACY FACTOR FORMULA MULTIPLIED BY .8<br>IF RESULT OF IN/OUT OF MONEY IS GREATER THAN 2 AND LESS THAN OR EQUAL TO 5 TAKE RESULT OF ACCURACY FACTOR FORMULA MULTIPLIED BY .6<br>IF RESULT OF IN/OUT OF MONEY IS GREATER THAN 5 AND LESS THAN OR EQUAL TO 8 TAKE RESULT OF ACCURACY FACTOR FORMULA MULTIPLIED BY .35<br>IF RESULT OF IN/OUT OF MONEY IS GREATER THAN 8 AND LESS THAN OR EQUAL TO 11 TAKE RESULT OF ACCURACY FACTOR FORMULA MULTIPLIED BY .15<br>IF RESULT OF IN/OUT OF MONEY IS GREATER THAN 11 AND LESS THAN OR EQUAL TO 14 TAKE RESULT OF ACCURACY FACTOR FORMULA MULTIPLIED BY .05<br>IF RESULT OF IN/OUT OF MONEY IS GREATER THAN 14 MAKE THE RESULT EQUAL .1 AND MAKE ALL HIGHER STRIKE PRICES EQUAL ZERO | | | | | | | | |
| RESULT IS CURRENT PRICE (ROUNDED) | 8.7 | 5.7 | 2.7 | 1.3 | 1.0 | 0.6 | 0.2 | 0.1 | 0.0 |

FIG. 7

INPUTS:

| | |
|---|---|
| FAVORITE'S SCORE | 70 |
| UNDERDOG'S SCORE | 75 |
| MINUTES LEFT | 16 |
| POINT SPREAD | 5 |
| SET OVER UNDER | 200 |

| UNDERDOG'S OPTION: | WIN BY MORE THAN 12 | WIN BY MORE THAN 9 | WIN BY MORE THAN 6 | WIN BY MORE THAN 3 | WIN BY 1 OR MORE | LOSE UNDER 3 OR WIN | LOSE UNDER 6 OR WIN | LOSE UNDER 9 OR WIN | LOSE UNDER 12 OR WIN |
|---|---|---|---|---|---|---|---|---|---|
| STRIKE PRICE | 88 | 91 | 94 | 97 | 100 | 103 | 106 | 109 | 112 |
| EXPLANATION OF FORMULA TO CALCULATE INDEX | FAVORITE'S SCORE MINUS UNDERDOG'S SCORE PLUS 100 (EXPLANATION IS SAME FOR ALL STRIKE PRICES) | | | | | | | | |
| 52 RESULT OF INDEX CALCULATION | 95 | 95 | 95 | 95 | 95 | 95 | 95 | 95 | 95 |
| EXPLANATION OF IN/OUT OF THE MONEY | INDEX MINUS THE STRIKE PRICE (EXPLANATION IS THE SAME FOR ALL STRIKE PRICES) | | | | | | | | |
| RESULT OF IN/OUT OF MONEY FORMULA | 7 | 4 | 1 | -2 | -5 | -8 | -11 | -14 | -17 |
| EXPLANATION OF FORMULA TO CALCULATE TIME DECAY ON POINT SPREAD | MINUTES LEFT DIVIDED BY TOTAL MINUTES IN PRO BASKETBALL GAME WHICH IS 48 (SAME FOR ALL STRIKE) | | | | | | | | |
| RESULT OF TIME DECAY ON POINT SPREAD | 0.3333333333 | 0.3333333333 | 0.3333333333 | 0.3333333333 | 0.3333333333 | 0.3333333333 | 0.3333333333 | 0.3333333333 | 0.3333333333 |
| EXPLANATION OF ACCURACY FACTOR FORMULA | RESULT OF TIME DECAY ON POINT SPREAD MULTIPLIED BY RESULT OF INDEX CALCULATION MULTIPLIED BY .01 (SAME FOR ALL STRIKE) | | | | | | | | |
| RESULT OF ACCURACY FACTOR FORMULA | 0.3166666667 | 0.3166666667 | 0.3166666667 | 0.3166666667 | 0.3166666667 | 0.3166666667 | 0.3166666667 | 0.3166666667 | 0.3166666667 |
| EXPLANATION OF FINAL PRICE CALCULATION | (EXPLANATION IS SAME FOR ALL STRIKE PRICES)<br>IF RESULT OF IN/OUT IS EQUAL TO OR LESS THAN ZERO THEN TAKE RESULT OF STRIKE PRICE MINUS INDEX PLUS RESULT OF TIME DECAY ON POINT SPREAD<br>IF RESULT OF IN/OUT OF MONEY IS GREATER THAN ZERO AND LESS THAN OR EQUAL TO 2 TAKE RESULT OF ACCURACY FACTOR FORMULA MULTIPLIED BY .7<br>IF RESULT OF IN/OUT OF MONEY IS GREATER THAN 2 AND LESS THAN OR EQUAL TO 5 TAKE RESULT OF ACCURACY FACTOR FORMULA MULTIPLIED BY .5<br>IF RESULT OF IN/OUT OF MONEY IS GREATER THAN 5 AND LESS THAN OR EQUAL TO 8 TAKE RESULT OF ACCURACY FACTOR FORMULA MULTIPLIED BY .3<br>IF RESULT OF IN/OUT OF MONEY IS GREATER THAN 8 AND LESS THAN OR EQUAL TO 11 TAKE RESULT OF ACCURACY FACTOR FORMULA MULTIPLIED BY .1<br>IF RESULT OF IN/OUT OF MONEY IS GREATER THAN 11 AND LESS THAN OR EQUAL TO 14 TAKE RESULT OF ACCURACY FACTOR FORMULA MULTIPLIED BY .03<br>IF RESULT OF IN/OUT OF MONEY IS GREATER THAN 14 MAKE THE RESULT EQUAL .1 AND MAKE ALL HIGHER STRIKE PRICES EQUAL ZERO | | | | | | | | |
| RESULT IS CURRENT PRICE (ROUNDED) | 0.1 | 0.2 | 0.2 | 2.3 | 5.3 | 8.3 | 11.3 | 14.3 | 17.3 |

FIG. 9

SCREEN PRINT #2

INPUTS :

| | |
|---|---|
| FAVORITE'S SCORE | 0 |
| UNDERDOG'S SCORE | 0 |
| MINUTES LEFT | 48 |
| POINT SPREAD | 5 |
| SET OVER UNDER | 200 |

| | | | | | | | | | |
|---|---|---|---|---|---|---|---|---|---|
| OVER OPTIONS: | OVER 160 | OVER 170 | OVER 180 | OVER 190 | OVER 200 | OVER 210 | OVER 220 | OVER 230 | OVER 240 |
| 80 STRIKE PRICE | 160 | 170 | 180 | 190 | 200 | 210 | 220 | 230 | 240 |

EXPLANATION OF FORMULA TO CALCULATE INDEX

IF MINUTES LEFT IS EQUAL TO 48, THEN USE THE SET OVER UNDER NUMBER. (SAME FOR ALL STRIKE PRICES)
IF MINUTES LEFT IS LESS THAN 48, TAKE THE SUM OF FAVORITE'S SCORE PLUS UNDERDOG'S SCORE, AND MULTIPLY THAT SUM BY 48 DIVIDED BY THE RESULT OF 48 MINUS MINUTES LEFT.
(OR) (FAVORITE'S SCORE PLUS UNDERDOG'S SCORE) MULTIPLIED BY (48/(48 MINUS MINUTES LEFT)

| | | | | | | | | | |
|---|---|---|---|---|---|---|---|---|---|
| 82 RESULT OF INDEX CALCULATION | 200 | 200 | 200 | 200 | 200 | 200 | 200 | 200 | 200 |

EXPLANATION OF IN/OUT OF THE MONEY

STRIKE PRICE MINUS THE INDEX (EXPLANATION IS THE SAME FOR ALL STRIKE PRICES)

| | | | | | | | | | |
|---|---|---|---|---|---|---|---|---|---|
| 84 RESULT OF IN/OUT OF MONEY FORMULA | -40 | -30 | -20 | -10 | 0 | 10 | 20 | 30 | 40 |

EXPLANATION OF FORMULA TO CALCULATE TIME DECAY ON POINT SPREAD

10 MULTIPLIED BY MINUTES LEFT DIVIDED BY TOTAL MINUTES IN PRO BASKETBALL GAME WHICH IS 48 (SAME FOR ALL STRIKE)

| | | | | | | | | | |
|---|---|---|---|---|---|---|---|---|---|
| 86 RESULT OF TIME DECAY | 10 | 10 | 10 | 10 | 10 | 10 | 10 | 10 | 10 |

EXPLANATION OF ACCURACY FACTOR FORMULA

RESULT OF TIME DECAY MULTIPLIED BY RESULT OF INDEX CALCULATION MULTIPLIED BY .01 (SAME FOR ALL STRIKE)

| | | | | | | | | | |
|---|---|---|---|---|---|---|---|---|---|
| 88 RESULT OF ACCURACY FACTOR FORMULA | 20 | 20 | 20 | 20 | 20 | 20 | 20 | 20 | 20 |

89 EXPLANATION OF FINAL PRICE CALCULATION (EXPLANATION IS SAME FOR ALL STRIKE PRICES)

IF RESULT OF IN/OUT IS EQUAL TO OR LESS THAN ZERO THEN TAKE RESULT OF INDEX MINUS STRIKE PRICE PLUS RESULT OF TIME DECAY
IF RESULT OF IN/OUT OF MONEY IS GREATER THAN ZERO AND LESS THAN OR EQUAL TO 2 TAKE RESULT OF ACCURACY FACTOR FORMULA MULTIPLIED BY .9
IF RESULT OF IN/OUT OF MONEY IS GREATER THAN 2 AND LESS THAN OR EQUAL TO 9 TAKE RESULT OF ACCURACY FACTOR FORMULA MULTIPLIED BY .65
IF RESULT OF IN/OUT OF MONEY IS GREATER THAN 9 AND LESS THAN OR EQUAL TO 19 TAKE RESULT OF ACCURACY FACTOR FORMULA MULTIPLIED BY .28
IF RESULT OF IN/OUT OF MONEY IS GREATER THAN 19 AND LESS THAN OR EQUAL TO 29 TAKE RESULT OF ACCURACY FACTOR FORMULA MULTIPLIED BY .08
IF RESULT OF IN/OUT OF MONEY IS GREATER THAN 29 AND LESS THAN OR EQUAL TO 39 TAKE RESULT OF ACCURACY FACTOR FORMULA MULTIPLIED BY .02
IF RESULT OF IN/OUT OF MONEY IS GREATER THAN 39 MAKE THE RESULT EQUAL .1 AND MAKE ALL HIGHER STRIKE PRICES EQUAL ZERO

| | | | | | | | | | |
|---|---|---|---|---|---|---|---|---|---|
| RESULT IS CURRENT PRICE (ROUNDED) | 50.0 | 40.0 | 30.0 | 20.0 | 10.0 | 5.6 | 1.6 | 0.4 | 0.1 |

FIG. 10

SCREEN PRINT
INPUTS :

| | |
|---|---|
| FAVORITE'S SCORE | 0 |
| UNDERDOG'S SCORE | 0 |
| MINUTES LEFT | 48 |
| POINT SPREAD | 5 |
| SET OVER UNDER | 200 |

| | | | | | | | | | |
|---|---|---|---|---|---|---|---|---|---|
| UNDER OPTIONS: | UNDER 160 | UNDER 170 | UNDER 180 | UNDER 190 | UNDER 200 | UNDER 210 | UNDER 220 | UNDER 230 | UNDER 240 |
| 90 STRIKE PRICE | 160 | 170 | 180 | 190 | 200 | 210 | 220 | 230 | 240 |

EXPLANATION OF FORMULA TO CALCULATE INDEX: IF MINUTES LEFT IS EQUAL TO 48, THEN USE THE SET OVER UNDER NUMBER. (SAME FOR ALL STRIKE PRICES)
IF MINUTES LEFT IS LESS THAN 48, TAKE THE SUM OF FAVORITE'S SCORE PLUS UNDERDOG'S SCORE, AND MULTIPLY THAT SUM BY 48 DIVIDED BY THE RESULT OF 48 MINUS MINUTES LEFT.
(OR) (FAVORITE'S SCORE PLUS UNDERDOG'S SCORE) MULTIPLIED BY (48/(48 MINUS MINUTES LEFT)

| | | | | | | | | | |
|---|---|---|---|---|---|---|---|---|---|
| 92 RESULT OF INDEX CALCULATION | 200 | 200 | 200 | 200 | 200 | 200 | 200 | 200 | 200 |

EXPLANATION OF IN/OUT OF THE MONEY: INDEX MINUS THE STRIKE PRICE (EXPLANATION IS THE SAME FOR ALL STRIKE PRICES)

| | | | | | | | | | |
|---|---|---|---|---|---|---|---|---|---|
| RESULT OF IN/OUT OF MONEY FORMULA | 40 | 30 | 20 | 10 | 0 | -10 | -20 | -30 | -40 |

EXPLANATION OF FORMULA TO CALCULATE TIME DECAY ON POINT SPREAD: 10 MULTIPLIED BY MINUTES LEFT DIVIDED BY TOTAL MINUTES IN PRO BASKETBALL GAME WHICH IS 48 (SAME FOR ALL STRIKE)

| | | | | | | | | | |
|---|---|---|---|---|---|---|---|---|---|
| RESULT OF TIME DECAY | 10 | 10 | 10 | 10 | 10 | 10 | 10 | 10 | 10 |

EXPLANATION OF ACCURACY FACTOR FORMULA: RESULT OF TIME DECAY MULTIPLIED BY RESULT OF INDEX CALCULATION MULTIPLIED BY .01 (SAME FOR ALL STRIKE)

| | | | | | | | | | |
|---|---|---|---|---|---|---|---|---|---|
| RESULT OF ACCURACY FACTOR FORMULA | 20 | 20 | 20 | 20 | 20 | 20 | 20 | 20 | 20 |

EXPLANATION OF FINAL PRICE CALCULATION: (EXPLANATION IS SAME FOR ALL STRIKE PRICES)
IF RESULT OF IN/OUT IS EQUAL TO OR LESS THAN ZERO THEN TAKE STRIKE PRICE MINUS RESULT OF INDEX PLUS RESULT OF TIME DECAY
IF RESULT OF IN/OUT OF MONEY IS GREATER THAN ZERO AND LESS THAN OR EQUAL TO 2 TAKE RESULT OF ACCURACY FACTOR FORMULA MULTIPLIED BY .9
IF RESULT OF IN/OUT OF MONEY IS GREATER THAN 2 AND LESS THAN OR EQUAL TO 9 TAKE RESULT OF ACCURACY FACTOR FORMULA MULTIPLIED BY .65
IF RESULT OF IN/OUT OF MONEY IS GREATER THAN 9 AND LESS THAN OR EQUAL TO 19 TAKE RESULT OF ACCURACY FACTOR FORMULA MULTIPLIED BY .28
IF RESULT OF IN/OUT OF MONEY IS GREATER THAN 19 AND LESS THAN OR EQUAL TO 29 TAKE RESULT OF ACCURACY FACTOR FORMULA MULTIPLIED BY .08
IF RESULT OF IN/OUT OF MONEY IS GREATER THAN 29 AND LESS THAN OR EQUAL TO 39 TAKE RESULT OF ACCURACY FACTOR FORMULA MULTIPLIED BY .02
IF RESULT OF IN/OUT OF MONEY IS GREATER THAN 39 MAKE THE RESULT EQUAL .1 AND MAKE ALL HIGHER STRIKE PRICES EQUAL ZERO

| | | | | | | | | | |
|---|---|---|---|---|---|---|---|---|---|
| RESULT IS CURRENT PRICE (ROUNDED) | 0.1 | 0.4 | 1.6 | 5.6 | 10.0 | 20.0 | 30.0 | 40.0 | 50.0 |

FIG. 12

SCREEN PRINT #8

INPUTS :

| | |
|---|---|
| FAVORITE'S SCORE | 70 |
| UNDERDOG'S SCORE | 75 |
| MINUTES LEFT | 16 |
| POINT SPREAD | 5 |
| SET OVER UNDER | 200 |

| | | | | | | | | | |
|---|---|---|---|---|---|---|---|---|---|
| OVER OPTIONS: | OVER 160 | OVER 170 | OVER 180 | OVER 190 | OVER 200 | OVER 210 | OVER 220 | OVER 230 | OVER 240 |
| STRIKE PRICE | 160 | 170 | 180 | 190 | 200 | 210 | 220 | 230 | 240 |
| EXPLANATION OF FORMULA TO CALCULATE INDEX | IF MINUTES LEFT IS EQUAL TO 48, THEN USE THE SET OVER UNDER NUMBER. (SAME FOR ALL STRIKE PRICES)<br>IF MINUTES LEFT IS LESS THAN 48, TAKE THE SUM OF FAVORITE'S SCORE PLUS UNDERDOG'S SCORE, AND MULTIPLY THAT SUM BY 48 DIVIDED BY THE RESULT OF 48 MINUS MINUTES LEFT.<br>(OR) (FAVORITE'S SCORE PLUS UNDERDOG'S SCORE) MULTIPLIED BY (48/(48 MINUS MINUTES LEFT) | | | | | | | | |
| RESULT OF INDEX CALCULATION | 217.5 | 217.5 | 217.5 | 217.5 | 217.5 | 217.5 | 217.5 | 217.5 | 217.5 |
| EXPLANATION OF IN/OUT OF THE MONEY | STRIKE PRICE MINUS THE INDEX (EXPLANATION IS THE SAME FOR ALL STRIKE PRICES) | | | | | | | | |
| RESULT OF IN/OUT OF MONEY FORMULA | -57.5 | -47.5 | -37.5 | -27.5 | -17.5 | -7.5 | 2.5 | 12.5 | 22.5 |
| EXPLANATION OF FORMULA TO CALCULATE TIME DECAY ON POINT SPREAD | 10 MULTIPLIED BY MINUTES LEFT DIVIDED BY TOTAL MINUTES IN PRO BASKETBALL GAME WHICH IS 48 (SAME FOR ALL STRIKE) | | | | | | | | |
| RESULT OF TIME DECAY | 3.333333333 | 3.333333333 | 3.333333333 | 3.333333333 | 3.333333333 | 3.333333333 | 3.333333333 | 3.333333333 | 3.333333333 |
| EXPLANATION OF ACCURACY FACTOR FORMULA | RESULT OF TIME DECAY MULTIPLIED BY RESULT OF INDEX CALCULATION MULTIPLIED BY .01 (SAME FOR ALL STRIKE PRICES) | | | | | | | | |
| RESULT OF ACCURACY FACTOR FORMULA | 7.25 | 7.25 | 7.25 | 7.25 | 7.25 | 7.25 | 7.25 | 7.25 | 7.25 |
| EXPLANATION OF FINAL PRICE CALCULATION | (EXPLANATION IS SAME FOR ALL STRIKE PRICES)<br>IF RESULT OF IN/OUT IS EQUAL TO OR LESS THAN ZERO THEN TAKE RESULT OF INDEX MINUS STRIKE PRICE PLUS RESULT OF TIME DECAY<br>IF RESULT OF IN/OUT OF MONEY IS GREATER THAN ZERO AND LESS THAN OR EQUAL TO 2 TAKE RESULT OF ACCURACY FACTOR FORMULA MULTIPLIED BY .9<br>IF RESULT OF IN/OUT OF MONEY IS GREATER THAN 2 AND LESS THAN OR EQUAL TO 9 TAKE RESULT OF ACCURACY FACTOR FORMULA MULTIPLIED BY .85<br>IF RESULT OF IN/OUT OF MONEY IS GREATER THAN 9 AND LESS THAN OR EQUAL TO 19 TAKE RESULT OF ACCURACY FACTOR FORMULA MULTIPLIED BY .28<br>IF RESULT OF IN/OUT OF MONEY IS GREATER THAN 19 AND LESS THAN OR EQUAL TO 29 TAKE RESULT OF ACCURACY FACTOR FORMULA MULTIPLIED BY .08<br>IF RESULT OF IN/OUT OF MONEY IS GREATER THAN 29 AND LESS THAN OR EQUAL TO 39 TAKE RESULT OF ACCURACY FACTOR FORMULA MULTIPLIED BY .02<br>IF RESULT OF IN/OUT OF MONEY IS GREATER THAN 39 MAKE THE RESULT EQUAL .1 AND MAKE ALL HIGHER STRIKE PRICES EQUAL ZERO | | | | | | | | |
| RESULT IS CURRENT PRICE (ROUNDED) | 60.8 | 50.8 | 40.8 | 30.8 | 20.8 | 10.8 | 4.7 | 2.0 | 0.6 |

FIG. 13

SCREEN PRINT #8

INPUTS :

| | |
|---|---|
| FAVORITE'S SCORE | 70 |
| UNDERDOG'S SCORE | 75 |
| MINUTES LEFT | 16 |
| POINT SPREAD | 5 |
| SET OVER UNDER | 200 |

| | | | | | | | | | |
|---|---|---|---|---|---|---|---|---|---|
| UNDER OPTIONS: | UNDER 160 | UNDER 170 | UNDER 180 | UNDER 190 | UNDER 200 | UNDER 210 | UNDER 220 | UNDER 230 | UNDER 240 |
| STRIKE PRICE | 160 | 170 | 180 | 190 | 200 | 210 | 220 | 230 | 240 |
| EXPLANATION OF FORMULA TO CALCULATE INDEX | IF MINUTES LEFT IS EQUAL TO 48, THEN USE THE SET OVER UNDER NUMBER. (SAME FOR ALL STRIKE PRICES)<br>IF MINUTES LEFT IS LESS THAN 48, TAKE THE SUM OF FAVORITE'S SCORE PLUS UNDERDOG'S SCORE, AND MULTIPLY THAT SUM BY 48 DIVIDED BY THE RESULT OF 48 MINUS MINUTES LEFT.<br>(OR) (FAVORITE'S SCORE PLUS UNDERDOG'S SCORE) MULTIPLIED BY (48/(48 MINUS MINUTES LEFT) | | | | | | | | |
| RESULT OF INDEX CALCULATION | 217.5 | 217.5 | 217.5 | 217.5 | 217.5 | 217.5 | 217.5 | 217.5 | 217.5 |
| EXPLANATION OF IN/OUT OF THE MONEY | INDEX MINUS THE STRIKE PRICE (EXPLANATION IS THE SAME FOR ALL STRIKE PRICES) | | | | | | | | |
| RESULT OF IN/OUT OF MONEY FORMULA | 57.5 | 47.5 | 37.5 | 27.5 | 17.5 | 7.5 | -2.5 | -12.5 | -22.5 |
| EXPLANATION OF FORMULA TO CALCULATE TIME DECAY ON POINT SPREAD | 10 MULTIPLIED BY MINUTES LEFT DIVIDED BY TOTAL MINUTES IN PRO BASKETBALL GAME WHICH IS 48 (SAME FOR ALL STRIKE) | | | | | | | | |
| RESULT OF TIME DECAY | 3.333333333 | 3.333333333 | 3.333333333 | 3.333333333 | 3.333333333 | 3.333333333 | 3.333333333 | 3.333333333 | 3.333333333 |
| EXPLANATION OF ACCURACY FACTOR FORMULA | RESULT OF TIME DECAY MULTIPLIED BY RESULT OF INDEX CALCULATION MULTIPLIED BY .01 (SAME FOR ALL STRIKE PRICES) | | | | | | | | |
| RESULT OF ACCURACY FACTOR FORMULA | 7.25 | 7.25 | 7.25 | 7.25 | 7.25 | 7.25 | 7.25 | 7.25 | 7.25 |
| EXPLANATION OF FINAL PRICE CALCULATION | (EXPLANATION IS SAME FOR ALL STRIKE PRICES)<br>IF RESULT OF IN/OUT IS EQUAL TO OR LESS THAN ZERO THEN TAKE STRIKE PRICE MINUS RESULT OF INDEX PLUS RESULT OF TIME DECAY<br>IF RESULT OF IN/OUT OF MONEY IS GREATER THAN ZERO AND LESS THAN OR EQUAL TO 2 TAKE RESULT OF ACCURACY FACTOR FORMULA MULTIPLIED BY .9<br>IF RESULT OF IN/OUT OF MONEY IS GREATER THAN 2 AND LESS THAN OR EQUAL TO 9 TAKE RESULT OF ACCURACY FACTOR FORMULA MULTIPLIED BY .65<br>IF RESULT OF IN/OUT OF MONEY IS GREATER THAN 9 AND LESS THAN OR EQUAL TO 19 TAKE RESULT OF ACCURACY FACTOR FORMULA MULTIPLIED BY .28<br>IF RESULT OF IN/OUT OF MONEY IS GREATER THAN 19 AND LESS THAN OR EQUAL TO 29 TAKE RESULT OF ACCURACY FACTOR FORMULA MULTIPLIED BY .06<br>IF RESULT OF IN/OUT OF MONEY IS GREATER THAN 29 AND LESS THAN OR EQUAL TO 39 TAKE RESULT OF ACCURACY FACTOR FORMULA MULTIPLIED BY .02<br>IF RESULT OF IN/OUT OF MONEY IS GREATER THAN 39 MAKE THE RESULT EQUAL .1 AND MAKE ALL HIGHER STRIKE PRICES EQUAL ZERO | | | | | | | | |
| RESULT IS CURRENT PRICE (ROUNDED) | 0.0 | 0.1 | 0.1 | 0.6 | 2.0 | 4.7 | 5.8 | 15.8 | 25.8 |

SPORTING EVENT OPTIONS MARKET TRADING GAME

BACKGROUND OF THE INVENTION

This invention relates to games, particularly to options market trading games. An option, of the type traded in a commodities market, is nothing more than a right (either to buy or sell) a particular commodity at a fixed price (called the settlement or "strike" price) at some time in the future. A call option is the right to buy the commodity in the future. A put option is the right to sell the commodity in the future. An option holder is the person who owns the right conveyed by the option. The option writer is the person who will have to perform (e.g. buy or sell at the fixed price) in accordance with the right granted by the option.

The intrinsic (or cash settlement) value of an option is equal to the difference between the settlement price of the option and the market value of the commodity. For example, a call option with a settlement price of $50 has an intrinsic value of $10 if the value of the commodity is currently $60, because the holder of the option could theoretically force the writer of the option to deliver $60 worth of the commodity for $50. Similarly, a put option with a settlement price of $50 has an intrinsic value of $10 if value of the commodity is currently $40, because the option holder could theoretically force the writer of the option to buy $40 worth of the commodity for $50. It is important to note that the intrinsic value of the option represents only the difference between the strike price and the current value of the commodity and does not reflect the price of the commodity itself. Thus a put option with a settlement price of $500 would still have an intrinsic value of only $10 if the value of the commodity was currently $490.

Options also have "time value," that is, options generally trade at some premium over their intrinsic value as dictated by market forces. The amount of the time value premium depends on a multitude of factors including the remaining life of the option (all options expire at some point in time) and the volatility of the particular commodity. For example, if the value of a commodity is currently $60, a call option with a settlement value of $50 has an intrinsic value of $10, but may trade at $12 in the open market. The $2 premium reflects the time value of the option.

The field is replete with various stock market and options market trading games. U.S. Pat. No. 5,139,269 to Peterson, discloses a board game in which a token is advanced around a board based on a roll of the dice. The market events that determine whether the player will realize a profit or loss are based upon the position of the tokens on the board and/or subsequent rolls of the dice. U.S. Pat. No. 4,378,942 to Isaac discloses a game in which the players buy and sell options with a "broker" for a predetermined period, after which the market events that determine whether the player will realize a profit or loss are determined by randomly drawn cards and tokens. U.S. Pat. No. 4,948,145 to Breslow discloses a game in which the market events are determined by spinning a spinner. In all of the prior art games, however, the market events are purely random, and therefore, the games lack a certain realism that would be inherent if the market events were determined by a real event.

It is a principal object of the present invention to provide an options trading game with enhanced realism, specifically to provide an options trading game in which the market events are determined by a real event occurring outside the game being played.

SUMMARY OF THE INVENTION

The present invention comprises an options trading game in which the simulated market, which determines whether the value of a commodities option rises or fails, is determined by a real event occurring outside the game being played. In a preferred embodiment, the event from which the simulated market is derived is a real-life contest, preferably a sporting event, such as a professional basketball, football, or baseball game. Preferably a host calculator or computer generates the initial option prices. This "host" computer then provides the information to a plurality of player stations, which could be additional computers, "dumb" terminals, television sets (or a portion thereof), or other conventional display means (hereinafter referred to as player "terminals"). At the beginning of play, each player is given a predetermined number of units (dollars) to spend on options. In a preferred embodiment, the host computer permits trading to take place before the beginning of the sporting event, during time outs, and during other breaks in the action, thus enabling the players to buy and sell their options throughout the event, yet still enjoy viewing the sporting event. However, continuous trading throughout the sporting event is also within the scope of the present invention. After play begins, the host computer updates the options prices using formulae based on the current score (as used herein, "score" means points scored by each team, total points scored by all teams, lead time between any two competitors in a race, number of hits, number of errors, shots on goal, or any other quantifiable representation of the progress of a contest), together with such parameters as, time remaining (or in the case of baseball, innings remaining), and a variety of other empirically determined factors, such as field position, downs remaining, yards to a first down, runners on base, balls and strikes, and number of outs. At the conclusion of the sporting event, the options are cashed in for their intrinsic value (i.e. their cash settlement value) and the player with the most accumulated wealth is declared the winner. Since, according to the present invention, the prices of the options fluctuate in response to the momentum of the sporting event, rather than in response to a purely random input, the game of the present invention adds a realism that cannot be achieved by a game that simulates the market by purely random means.

BRIEF DESCRIPTION OF THE DRAWINGS

The above and other objects, aspects, features and attendant advantages of the present invention will become apparent from a consideration of the ensuing detailed description of presently preferred embodiments and methods thereof, taken in conjunction with the accompanying drawings, in which:

FIG. 3 is a summary of formulae for calculating the simulated "favorite" commodities options prices of FIG. 2 and the results.

FIG. 4 is a summary of formulae for calculating the simulated "underdog" commodities options prices of FIG. 2 and the results.

FIG. 6 is a summary of formulae for calculating the simulated "favorite" commodities options prices of FIG. 5 and the results.

FIG. 7 is a summary of formulae for calculating the simulated "underdog" commodities options prices of FIG. 5 and the results.

FIG. 9 is a summary of formulae for calculating the simulated "over" commodities options prices of FIG. 8 and the results.

FIG. 10 is a summary of formulae for calculating the simulated "under" commodities options prices of FIG. 8 and the results.

FIG. 12 is a summary of formulae for calculating the simulated "over" commodities options prices of FIG. 11 and the results.

FIG. 13 is a summary of formulae for calculating the simulated "under" commodities options prices of FIG. 11 and the results.

DESCRIPTION OF PREFERRED EMBODIMENTS AND METHODS

Figure 1:
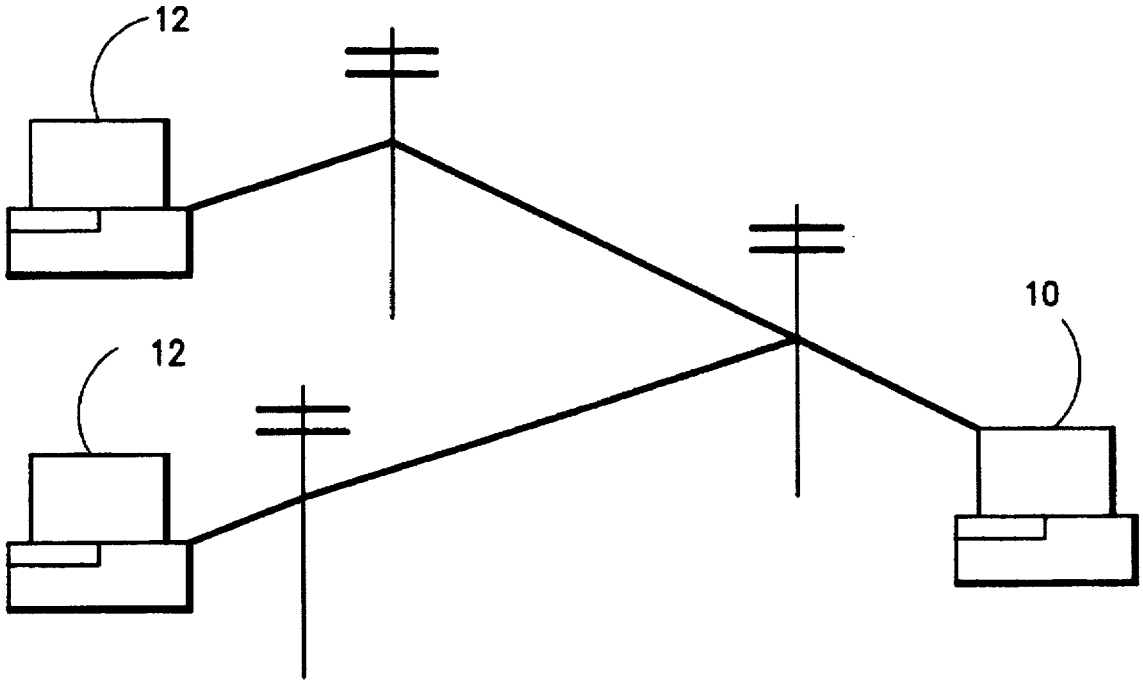
FIG. 1 is an illustration of a host computer and a network of player terminals according to an embodiment of the present invention.

The present invention comprises an options trading game in which the game's simulated market moves in response to occurrences in a real life event happening outside the game, such as in a sporting event. As shown in FIG. 1, in a preferred embodiment, a "host" calculator or computer 10 generates the options prices. This host computer then provides the information to a plurality of player computers or terminals 12 via Local Area Network, Wide Area Network, or other computer networks such as are well known in the computer field.

Figure 2:
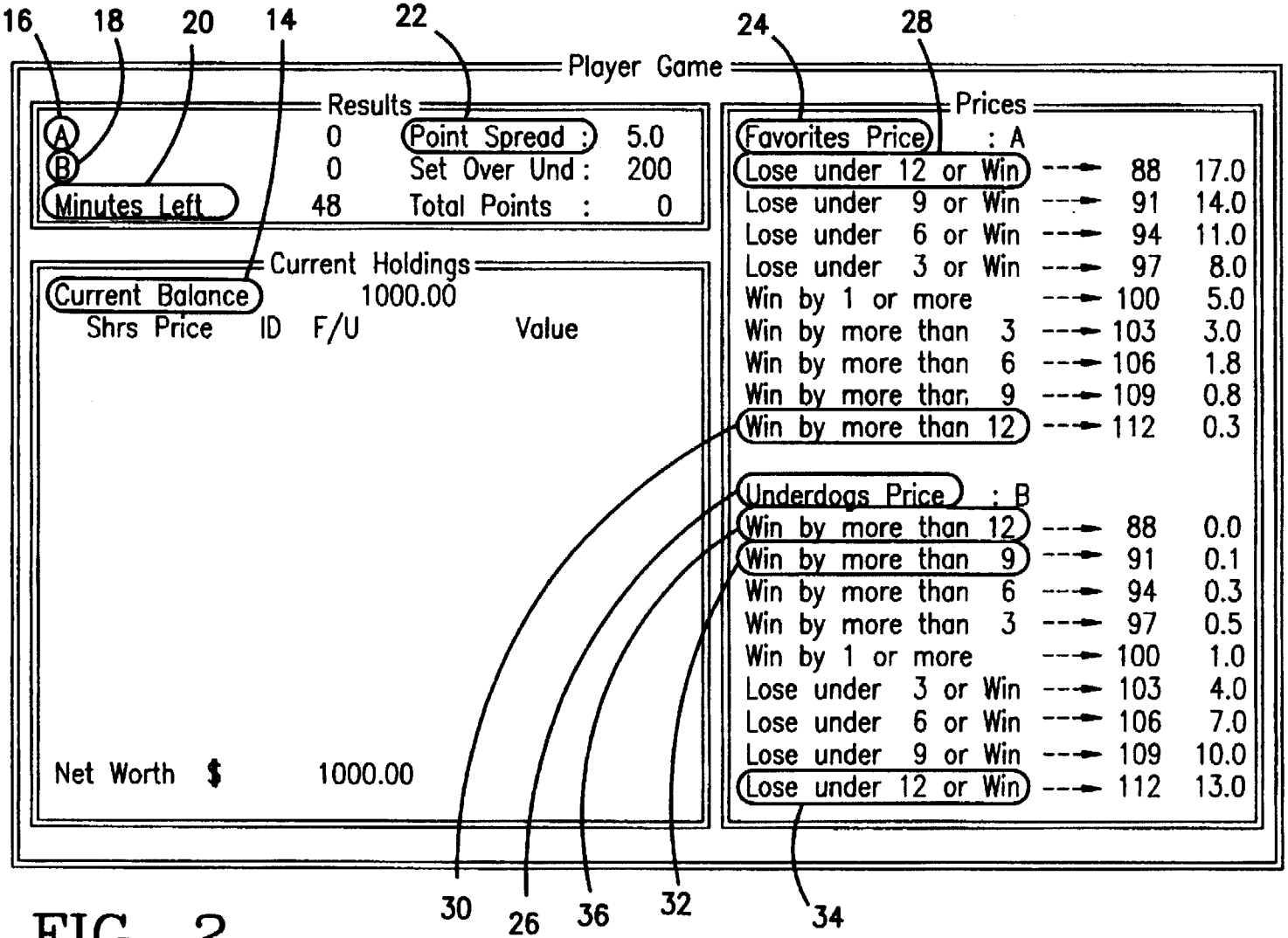
FIG. 2 is an illustration of a player terminal screen at the beginning of a game played according to an embodiment of the present invention.

FIG. 2 is an exemplary player's terminal display. At the beginning of play, each player is given a predetermined number of units (dollars) to spend on options, for example, $1,000 as shown at reference 14 of FIG. 2. In the embodiment of the present invention shown in FIG. 2, the sporting event used to simulate the market is a basketball game between team A 16 which is a 5 point favorite over team B 18. The sporting event has not yet commenced. Accordingly, the time remaining 20 is 48 minutes (the total time of a regulation basketball game). Referring to the favorite's price column 24 the player learns that team A is the favorite and that team B is the underdog as indicated in the underdog's price column 26. Referring to the point spread 22 the player learns that the favorite is favored to win by a 5 point spread.

The favorite's options available for purchase as indicated in FIG. 2 range from an option on the favorite doing no worse than losing by 11 points (i.e. "lose under 12 or win") 28 to an option on the favorite winning by at least 13 (i.e. "win by more than 12") 30. The "lose under 12 or win" option has a strike price of $88 and a trading value (intrinsic value plus time value) of $17. The "win by more than 12" option has a strike price of $112 and a trading value of $0.30. Since team A is the favorite, it is highly likely that team A will do no worse than losing by 11 points. Accordingly, the "lose under 12 or win" option has a high price. Similarly, because team A is only favored to win by 5 points, it is moderately unlikely that team A will actually win by more than 12. Accordingly, the "win by more than 12" option is fairly inexpensive.

Similarly, the underdog's options range from an option that the underdog will win by at least 10 (i.e. "win by more than 9") 32 to an option that the underdog will lose by less than 12 (i.e. "lose under 12 or win") 34 at the strike prices and trading values indicated. The apparent option that the underdog will win by at least 13 (i.e. "win by more than 12") 36 having an apparent strike price of $88 is actually out-of-range as indicated by a trading price of $0.0. Options having a price of $0.0 cannot be purchased.

As with the favorite's options, since the underdog is only a 5 point underdog, it is highly probable that it will not lose by more than 12. Accordingly, this option has a high trading price. Similarly, the probability that the underdog would win by more than 9 is quite low and, therefore, the price for this option is also quite low.

The strike prices appearing in the favorite's price column 24 of FIG. 2 are shown in row format in FIG. 3 at 40. The strike prices function as calibration constants, the range of which is empirically determined based on the probable volatility of scoring in the game. Although it is within the scope of the present invention to provide strike prices in one point increments, to do so would result in a potentially unmanageable number of options (from a player's prospective). Similarly, too coarse a strike price increment would result in options that were too insensitive to the movement of the market. Accordingly, in the embodiment of FIG. 2, since a basketball game is generally scored in 2 point increments, strike price increments are set at 3 points as a reasonable compromise between sensitivity to the movement of the market and the number of options necessary for an easily playable game.

The strike price of a "win" is arbitrarily set at $100 with the remaining strike prices set at $100 plus or minus the particular strike price increment. In the case of winning by an excess amount the strike prices are set at $100 plus the strike price increment and, in the case of losing by less than a set amount, the strike prices are set at $100 minus the strike price increment. Thus, the strike price for the favorite to "win by more than three" is $103, "win by more than six" is $106, etc. Similarly the strike price for the favorite to "lose by less than three" is $97, "lose by less than 6" is $94, etc.

The score index 42 is analogous to the current value of the underlying commodity of an option and is calculated according to the formula:

$$IX=100+(FS-US);$$

where IX is the index for a particular option, FS is the favorite's current score and US is the underdog's current score. As shown in FIG. 3, where play has not begin, FS–US is zero and the index is equal to 100.

The "in/out of the money" calculation ("I/O") is the equivalent of the intrinsic value of a real-life option, except that the signs are reversed. A option that is in the money shows up as having a negative "I/O" value and an option that is out of the money shows up as having a positive I/O value. The value of the I/O variable in the game is equal to the strike price of each option minus the index (i.e., strike price minus the value of the commodity). Thus, where the score index exceeds the strike price of an option on the favorite, the option holder is in the money. Where the strike price of an option on the favorite exceeds the score index, the option holder is out of money. (In this regard, the holder of options on the favorite is analogous to a futures trader holding "call" options. The greater the magnitude by which the index (value of the commodity) exceeds the strike price (settlement price), the greater the value of the call option.)

The strike prices appearing in the underdog's price column 26 of FIG. 2 are shown in row format in FIG. 4 at 50. As with the favorite's strike prices, the underdog's strike prices function as calibration constants and move in increments that are the same as the favorite's strike price increments. The strike price of a "win" is set at $100 with the remaining strike prices set at $100 plus or minus the particular strike price increment. In the case of losing by less than a set amount, the strike prices are set at $100 plus the particular strike price increment and, in the case of winning by an excess amount, the strike prices are set at $100 minus the strike price increment. (Note that this is the opposite of the favorite's strike price formula). Thus, the strike price for the underdog to "win by more than three" is $97, "win by more than six" is $94, etc. Similarly the strike price for the underdog to "lose by less than three or win" is $103, "lose by less than 6 or win" is $106, etc.

The score index 52 is the same as the index used in the favorite's calculations.

$$IX=100+(FS-US);$$

where IX is the index for a particular option, FS is the favorite's current score and US is the underdog's current score. The value of the "in/out of the money" variable is equal to the index minus the strike price of each option (the opposite of the favorite's I/O calculation). Thus, where the score index exceeds the strike price of an option on the underdog, the option holder is out of the money. Where the strike price of an option on the underdog exceeds the score index, the option holder is in the money. (In this regard, the holder of options on the underdog is analogous to a futures trader holding "put" options. The greater the magnitude by which the strike price (settlement price) exceeds the index (value of the commodity) the greater the value of the put option.) As can be seen from the foregoing discussion, in the preferred embodiment of FIG. 2, the intrinsic value of the options are based predominantly on the current score of the sporting event. However, it is within the scope of the present invention to model a market based on other parameters characteristic to a particular sporting event, such as the total number of points scored by all participants, the interval between participants (in a race), the number of hits, or shots on goal, or any other quantifiable parameter for determining the progress of a sporting event or the relative progress of its participants. Thus, as used herein, "score" means any quantifiable representation of the progress of a competitive event.

The foregoing method for calculating intrinsic value of an array of options for the purpose of an options trading game represents a substantial improvement over prior art games, by providing a simulated market that is based on a real, rather than a purely random event. Such a game, based only on the intrinsic value of the options would be suitable for play as a beginner's game. A most preferred embodiment of the present invention, however, includes a further refinement—that of simulating the time value that the market would place on a particular option and calculating a premium based on the time value.

With reference to FIG. 3, the time decay factor 46 for the favorite is equal to the original point spread multiplied by the ratio of minutes remaining in the game divided by the total length of the game, or expressed as a formula:

$$TD=IPS\times(TR/TT);$$

where TD is the time decay factor, IPS is the initial point spread, TR is the time remaining and TT is the total length of the game.

The accuracy formula factor 48 is a weighted multiplier equal to the 0.01 multiplied by the index multiplied by the time decay factor, or expressed as a formula:

$$AF=0.01\ (IX)\times(TD)$$

where AF is the accuracy factor, IX is the index and TD is the time decay factor calculated above. Thus, the favorite's accuracy factor is a measure of the percentage of the game remaining weighted by the original point spread. Where used, the accuracy factor provides a weighted straight line depreciation of the time value of the options as the game progresses.

The final trading price 49 of a particular favorite's option is adjusted by one of two time dependent multipliers: the time decay factor or a time value multiplier. Which of the two time dependent multipliers is used is determined by a series of screens based on the result of the I/O calculation. If the I/O variable is zero or a negative number, indicating the option is at or in the money, the trading price "P" is simply equal to the index minus the strike price plus the time decay factor—which is the same as the intrinsic value of the option (−I/O) plus the time decay factor:

$$P=IX-SP+TD=-(I/O)+TD$$

For all values of the in/out variable ("I/O") that are greater than zero (out of the money), the trading price is equal to the accuracy factor multiplied by the time value multiplier. If the I/O variable is greater than 0 and less than or equal to 2 (i.e. out of the money by less than $2) the time value multiplier is set equal to 0.8 and the trading price of the option is equal to 80% of the accuracy factor. If I/O is greater than 2 and less than or equal to 5 (i.e. out of the money by $2–5), the trading price of the option is equal to 60% of the accuracy factor. If I/O is greater than 5 and less than or equal to 8, the trading price of the option is equal to 35% of the accuracy factor. If I/O is greater than 8 and less than or equal to 11, the trading price of the option is equal to 15% of the accuracy factor. If I/O is greater than 11 and less than or equal to 14, the trading price of the option is equal to 5% of the accuracy factor. If I/O is greater than 14, the trading price of the first option greater than 14 is set equal to $0.10 (irrespective of the intrinsic value of the option) and the price of the remaining options greater than 14 are set to zero (out of range). Options with a purchase price of zero cannot be purchased.

As can be seen from FIG. 3, an option on the favorite to lose by less than 3 or win has a strike price of $97. The index at the beginning of the game is always 100, because the score is always tied at the beginning of a game. Thus, according to the I/O formula, the lose by less than 3 option is in the money by $3 (the intrinsic value of the option). Because the ratio of time remaining to total time is equal to unity at the beginning of a game, the result of the favorite's time decay formula at the beginning of the game is always equal to the initial point spread. Similarly, because the index is always 100 at the beginning of a game, and 0.01×100 is equal to unity, the result of the accuracy factor at the beginning of a game is always equal to the time decay value. Thus, at the beginning of a game having a point spread of 5, a favorite's option that is in the money by $3 at the beginning of the game will have a price of $8 (the initial point spread plus the intrinsic value of the option).

With reference to FIG. 4, the time decay factor 56 for the underdog is equal to simply the ratio of minutes remaining in the game divided by the total length of the game, without an adjustment for the point spread, or expressed as a formula:

$$TD=(TR/TT);$$

where TD is the time decay factor, TR is the time remaining and TT is the total length of the game.

As with the favorite's options calculations, the accuracy formula factor 58 for the underdog is a weighted multiplier equal to the 0.01 multiplied by the index multiplied by the time decay factor, or expressed as a formula:

$$AF=0.1\ (IX)\times(TD)$$

where AF is the accuracy factor, IX is the index and TD is the time decay factor calculated above. Thus, where used, the underdog's accuracy factor provides an unweighted straight line depreciation of the time value of the options as the game progresses.

The final trading price 59 of the underdog options are also adjusted by one of two time dependent multipliers: The time decay factor or a time value multiplier. Which of the two time dependent multipliers is used is determined by a series of screens based on the result of the in/out of the money variable. If the in/out variable is zero or a negative number, indicating the option is at or in the money, the trading price "P" is simply equal to the strike price minus the index plus the time decay factor—which is the same as the intrinsic value of the option (−I/O) plus the time decay factor:

$$P=SP-IX+TD=-(I/O)+TD$$

For all values of the I/O variable that are greater than zero (out of the money), the trading price is equal to the accuracy factor multiplied by the time value multiplier. If the I/O variable is greater than 0 and less than or equal to 2, the time value multiplier is set equal to 0.7 and, the trading price of the option is equal to 70% of the accuracy factor. If I/O is greater than 2 and less than or equal to 5, the trading price of the option is equal to 50% of the accuracy factor. If I/O is greater than 5 and less than or equal to 8, the trading price of the option is equal to 30% of the accuracy factor. If I/O is greater than 8 and less than or equal to 11, the trading price of the option is equal to 10% of the accuracy factor. If I/O is greater than 11 and less than or equal to 14, the trading price of the option is equal to 3% of the accuracy factor. If I/O is greater than 14, the trading price of the first option greater than 14 is set equal to $0.10 and the price of the remaining options greater than 14 are set to zero (out of range). Options with a purchase price of zero cannot be purchased.

As can be seen from FIG. 4, for example, an option on the underdog to win by more than 3 has strike price of $97. As discussed above, the index at the beginning of the game is always $100, because the score is always tied at the beginning of a game. Thus, according to the I/O formula, the win by more than 3 option is out of the money by $3 (i.e. it has negative intrinsic value). Because the ratio of time remaining to total time is equal to unity at the beginning of a game, the result of the time decay formula for the underdog at the beginning of the game is always equal to one. Similarly, because the index is always $100 at the beginning of a game, and 0.01×100 is equal to unity, the result of the accuracy factor at the beginning of a game is always equal to the time decay value. Thus, at the beginning of a game an underdog option that is out of the money by $3 at the beginning of the game will have a price of $0.50 (equal to the accuracy factor (1) multiplied by 0.5, (the time value multiplier for an option that is out of the money by $2–5)).

The values of the time value multipliers, and the ranges to which each of the multipliers apply, as described in the preferred embodiment, are empirically determined. Generally, however, the further an option is out of the money, the less likely it is that the option will have intrinsic value at the end of the game and, therefore, the less expensive it must be. Therefore, the limits on the time value multipliers are that they must be less than one (to prevent an out of the money option from being more costly than an in the money option) and they must be in descending order (to prevent an option that is further out of the money from being more costly than an option that is less out of the money). Accordingly, within the scope of the present invention, each of the time value multipliers could be from 0 to 0.99, provided the above criteria is met. Alternatively, the time value multipliers could be adjusted by a linear formula rather than a series of screens, or by a fuzzy logic program responsive to the trading activity. The magnitude of the multipliers discussed in the preferred embodiment provided sufficient discrimination to make a playable game, without excessive programming complexity.

Preferably, the host computer permits trading to take place before the beginning of the sporting event, during time outs, and during other breaks in the action, thus enabling the players to buy and sell their options throughout the event, yet still enjoy viewing the sporting event itself.

Figure 5:
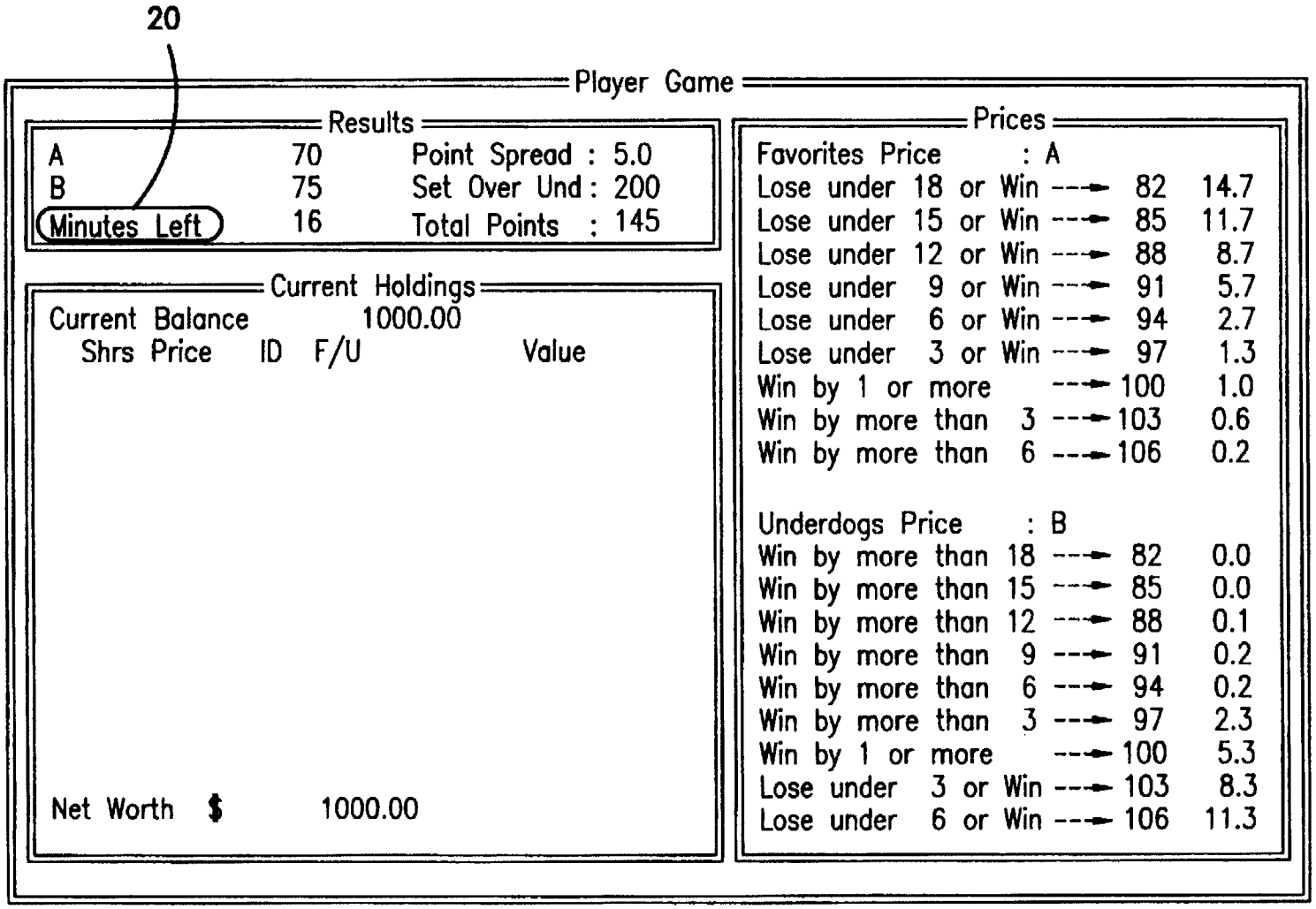
FIG. 5 is an illustration of the player terminal screen according to the embodiment of FIG. 2 at a point in time during the sporting event.

FIG. 5 depicts a player terminal display late in the third quarter of the simulated basketball game. The time remaining 20 is 16 minutes and the underdog team B is currently leading by 5 points. As can be seen from a comparison of FIG. 5 with FIG. 2, a feature of the present invention is that as out-of-range options accumulate due to a wide disparity in score or other factors, the out-of-range options roll off the screen and are replaced with new options appearing at the opposite end of the field.

FIG. 6 shows the calculations for the favorite's options. With reference to FIG. 6, the index 42 is now $95. Thus the intrinsic value of an option on the favorite to lose by less than three or win is −$2 (down from $8 at the beginning). The time decay multiplier is 1.666667—the point spread multiplied by the ratio of time remaining to total time, i.e. 5×(16/48). The accuracy factor is 1.583333—0.01 multiplied by the index multiplied by the time decay multiplier, .i.e. 0.01×($95)×(1.66667). Since the option is out of the money by $2, the final trading price of the option at this point is the accuracy factor multiplied by the time value multiplier for the range of $0–2 (i.e. 1.5833333×0.8=1.2667=$1.30 rounded to the nearest $0.10). $1.30 represents an 87% loss from the original price of $8.00.

FIG. 7 shows the calculations for the underdog options. The index 52 is still $95. Thus, the intrinsic value of an option on the underdog winning by more than three is $2 (up from $0.50 at the beginning of the event). The time decay multiplier is 0.3333333—the ratio of time remaining to total time (i.e. 16/48). The accuracy factor is 0.316777—0.01 multiplied by the index multiplied by the time decay multiplier, i.e 0.01×($95)×(0.333333). Since the option is in money, the trading price of the option is the intrinsic value plus the time decay multiplier .i.e. $2+$0.31677, or $2.30 rounded to the nearest $0.10). $2.30 represents a 460% increase over the original price of $0.50.

Figure 8:
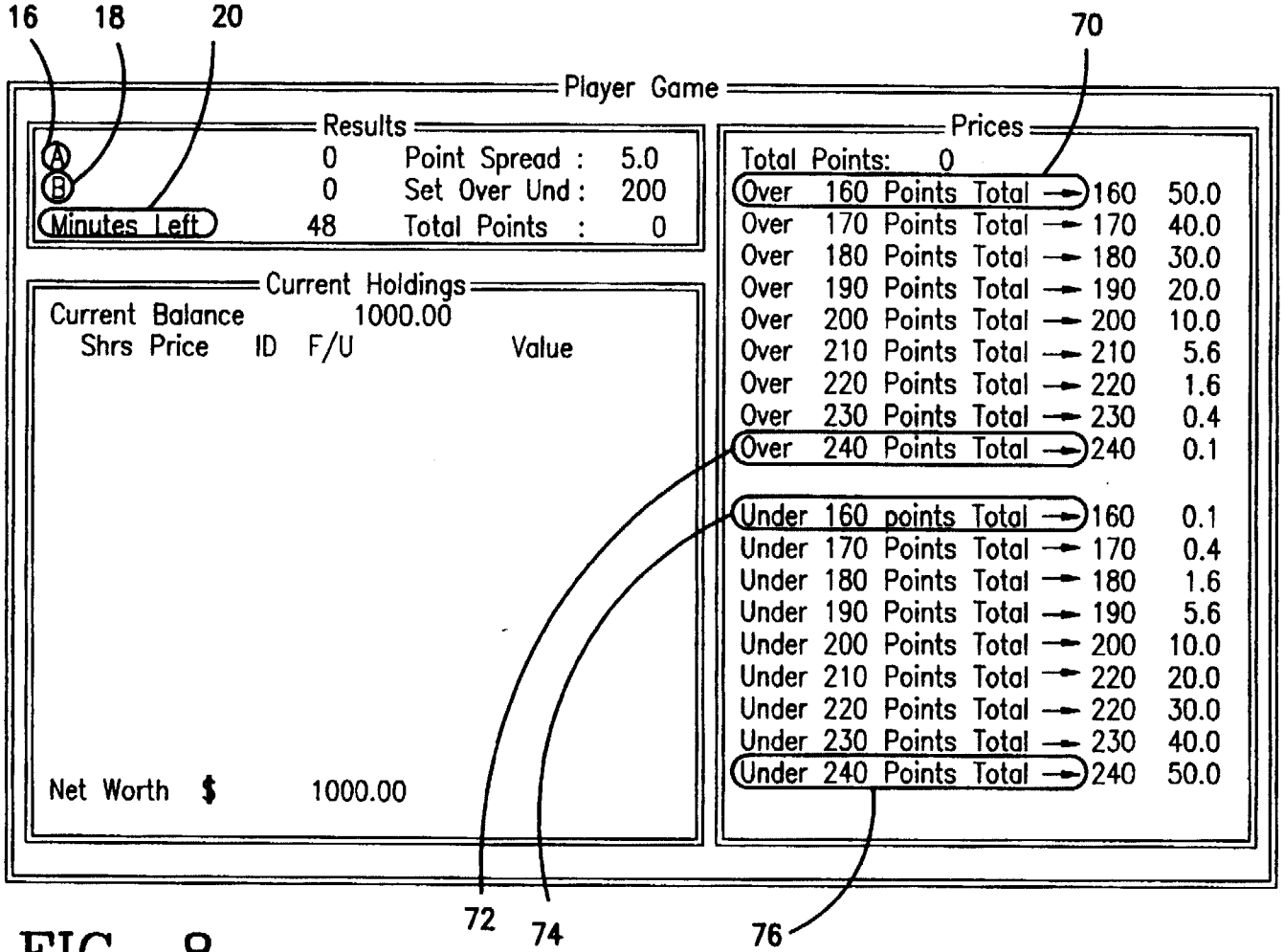
FIG. 8 is an illustration of a player terminal screen at the beginning of a game played according to a second embodiment of the present invention.

In another embodiment of the present invention, instead of the market being simulated predominantly by the difference between the scores of the two teams in the basketball game, the market is simulated by the total score of the two teams. FIG. 8 shows an exemplary player's terminal display in a game based on the same sporting event as the embodiment of FIG. 2, with team A 16 and team B 18 playing. As with FIG. 2, the game begins with no score and remaining time 20 of 48 minutes. Instead of favorite and underdog options, however, the commodities options available in the game of FIG. 8 are options on whether the total points scored will exceed or fall short of a preselected point total.

The "over" options available for purchase as indicated in FIG. 8 range from an option 70 on the total points scored exceeding 160 to an option 72 on the total points scored exceeding 240 points. The score over 160 points option has a strike price of 160 and a price of $50.00. The score over 240 points option has a strike price of 240 and a price of $0.10. Since a typical basketball game averages about 200 total points, it is highly likely that at least 160 points will be scored. Accordingly, the "score over 160 points" option has a high price. Similarly, it is moderately unlikely that more than 240 points will be scored. Accordingly, the "score more than 240 points" option is fairly inexpensive.

The "under" options available for purchase as indicated in FIG. 8 range from an option 74 on the total points scored failing short of 160 to an option 76 on the total points scored falling short of 240 points. The score under 160 points option has a strike price of $160 and a price of $0.10. The score under 240 points option has a strike price of 240 and a price of $50.00. Since, as discussed above, a typical basketball game averages about 200 total points, it is highly unlikely that fewer than 160 points will be scored. Accordingly, the "score under 160 points" option has a low price. Similarly, it is highly probable that fewer than 240 points will be scored. Accordingly, the "score under 240 points" option is fairly expensive.

The "over" strike prices appearing in FIG. 8 are shown in row format in FIG. 9 at 80. The target score "TS" is empirically determined based on the average points likely to be scored in a particular game. As in the favorite/underdog game, the strike prices function as calibration constants, the range and increments of which are empirically determined based on a compromise between sensitivity to scoring and keeping the number of options to a manageable size. In the embodiment of FIG. 8, the strike price increment is set to $10.

The index 82 is a straight line extrapolation of the points scored during the time played thus far extrapolated to the end of the game. The index is equal to the total points scored in the game thus far divided by the time played thus far multiplied by the total time of the game, or expressed as a formula:

$$IX=TT\times(FS+US)/(TT-TR)$$

where IX is the index, TT is the total time for regulation play, TR is the time remaining, FS is the favorite's score, and US is the underdog's score. At the beginning of the game, there is no data from which to extrapolate a predicted final score.

Accordingly, at the start of the game, the index is simply set to the empirically determined target score TS.

The in/out of the money calculation 84 is equal to the strike price minus the Index (SP–IX). The time decay formula is a straight ratio of the time remaining over the total time, multiplied by a scale factor of 10, i.e $$TD=10\ (TR/TT)$$

where TD is the time decay factor, TR is the time remaining and TT is the total time of the game.

The accuracy factor is calculated as follows:

$$AF=0.01\ (IX)\times(TD)$$

where AF is the accuracy factor, TD is the time decay factor, and IX is the index.

Finally the trading prices for the options 89 are adjusted by one of two time dependent multipliers: the time decay factor or a time value multiplier. Which of the two multipliers is used is determined by a series of screens based on the result of the in/out of the money variable. If the in/out variable is zero or negative, indicating the option is at or in the money, the trading price "P" is simply equal to the index minus the strike price plus the time decay factor—which is the same as the intrinsic value of the option (–I/O) plus the time decay factor:

$$P=IX-SP+TD=-(I/O)+TD$$

For all values of the in/out variable ("I/O ") that are greater than zero (out of the money), the trading price is equal to the accuracy factor multiplied by the time value multiplier. If the I/O variable is greater than 0 and less than or equal to 2, (out of the money by less than $2) the time value multiplier is set equal to 0.9 and, the trading price of the option is equal to 90% of the accuracy factor. If I/O is greater than 2 and less than or equal to 9 (out of the money by $2–9), the time value multiplier is equal to 0.65 and the trading price of the option is equal to 65% of the accuracy factor. If I/O is greater than 9 and less than or equal to 19, the trading price of the option is equal to 28% of the accuracy factor. If I/O is greater than 19 and less than or equal to 29, the trading price of the option is equal to 8% of the accuracy factor. If I/O is greater than 29 and less than or equal to 39, the trading price of the option is equal to 2% of the accuracy factor. If I/O is greater than 39, the trading price of the first option greater than 39 is set equal to $0.10 and the price of the remaining options greater than 39 are set to zero (out of range). As with the favorite/underdog game, options with a purchase price of zero cannot be purchased.

The "under" option strike prices appearing in FIG. 8 are shown in row format in FIG. 10 at 90. The index 92 for the under options is the same as the index for the "over" options. The in/out of the money calculation for the "under" options is the negative of the "over" option, namely the index minus the strike price. The time decay, accuracy factor, and final price are all calculated in the same manner as the time decay, accuracy factor, and final price for the "over options"

Figure 11:
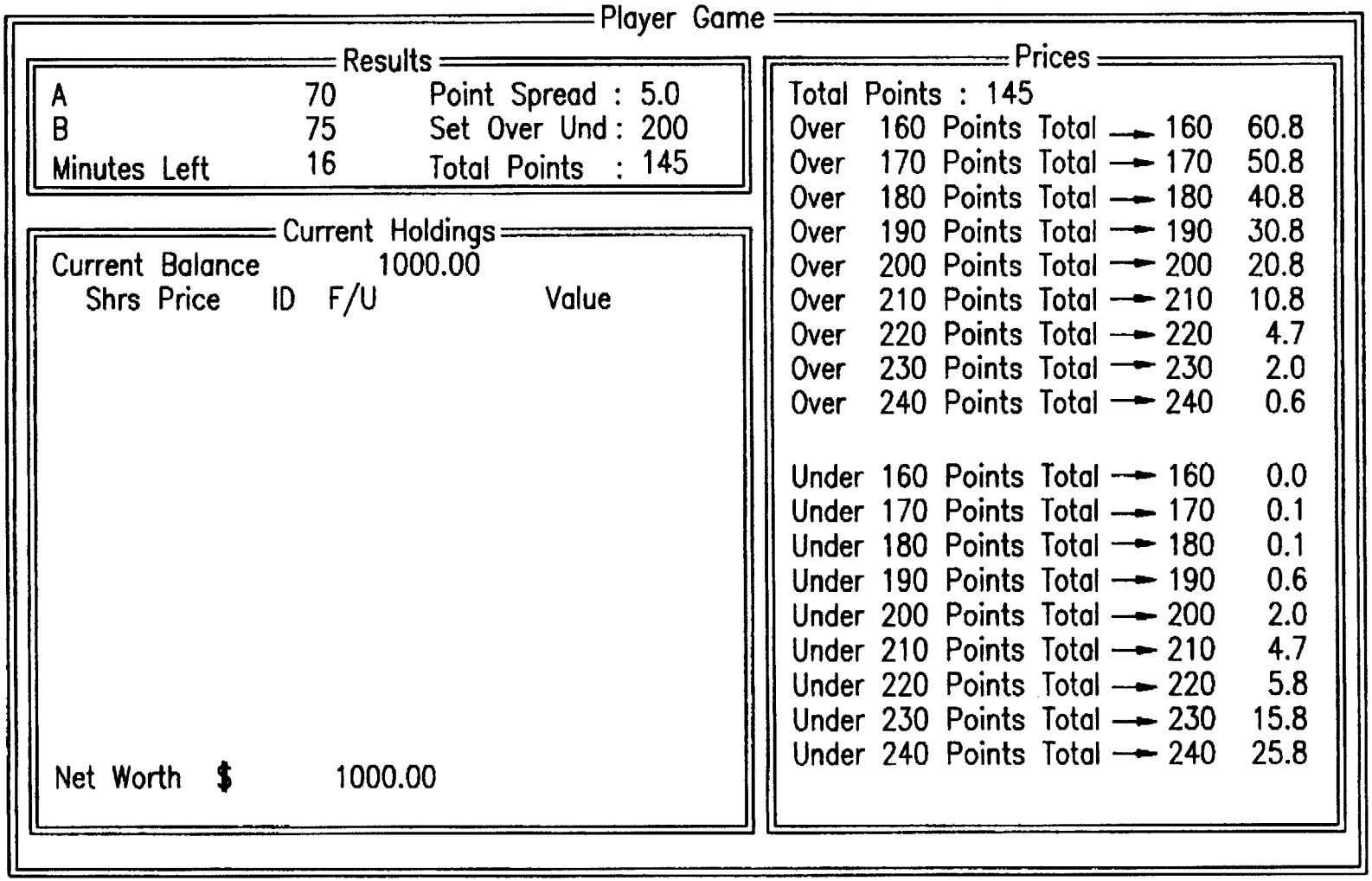
FIG. 11 is an illustration of the player terminal screen according to the embodiment of FIG. 8 at a point in time during the sporting event.
Figure 14:
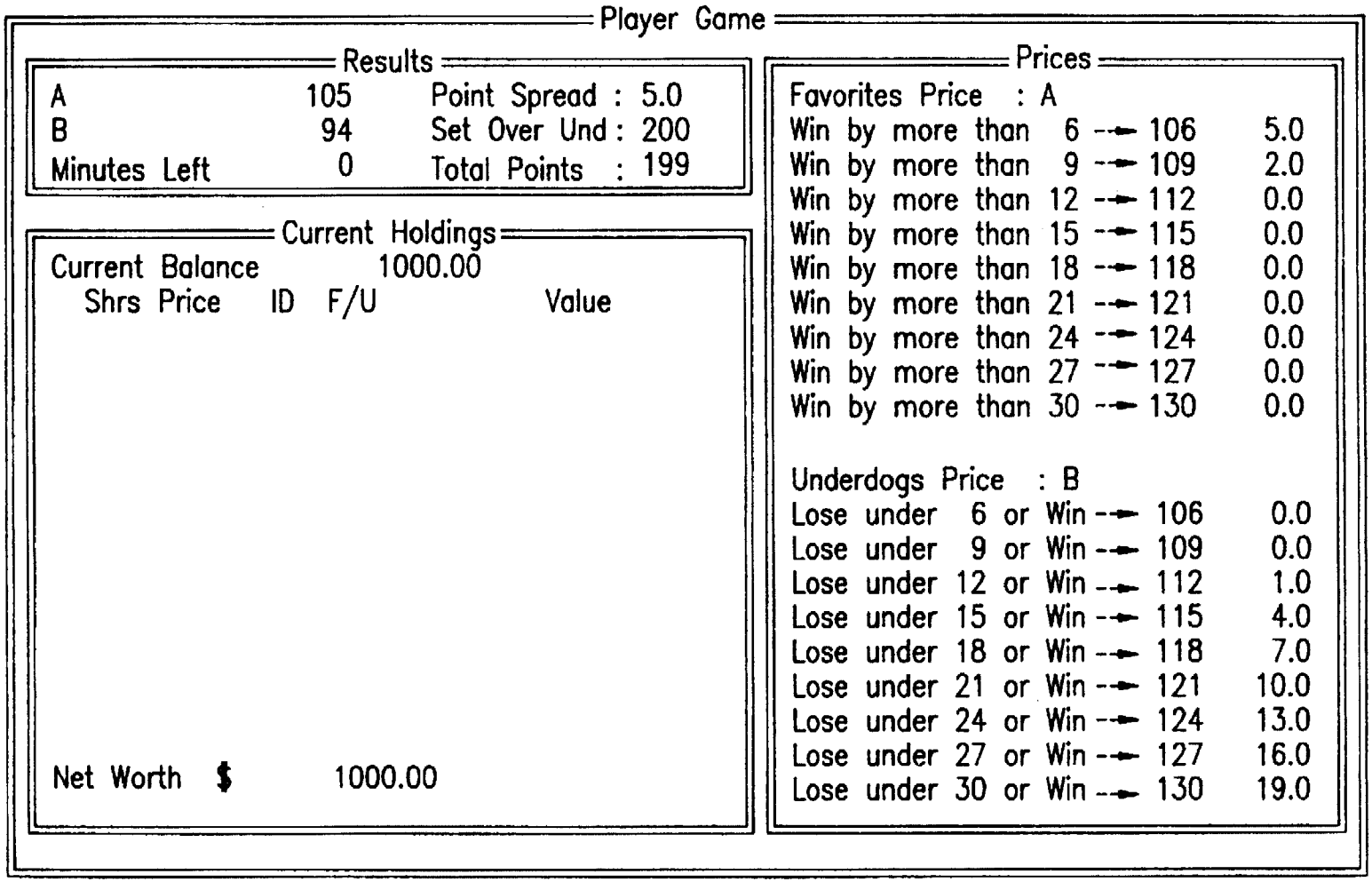
FIG. 14 is an illustration of a player terminal screen at the end of a game played according to the embodiment of the present invention of FIGS. 2–7.
Figure 15:
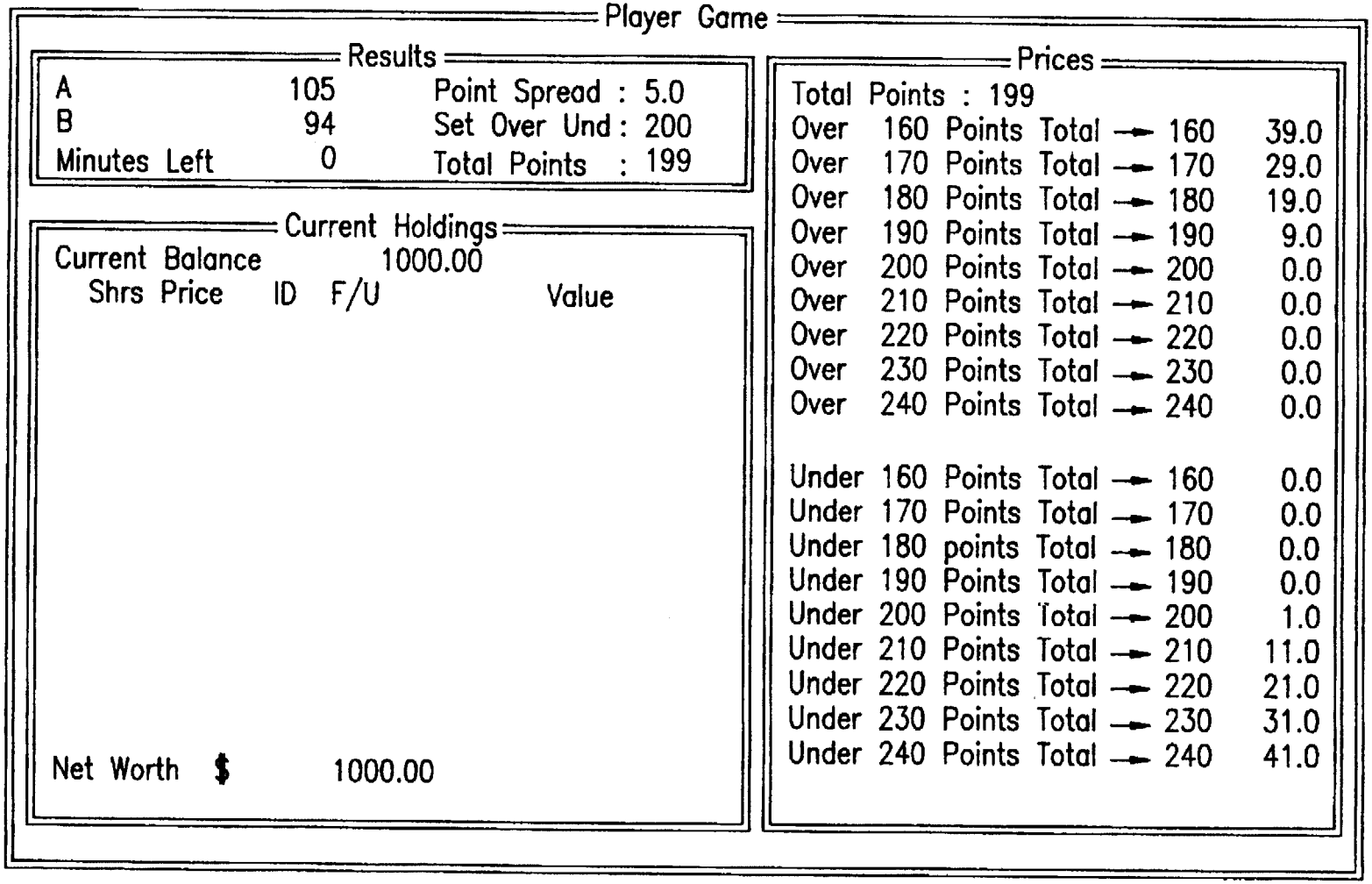
FIG. 15 is an illustration of a player terminal screen at the end of a game played according to the embodiment of the present invention of FIGS. 8–13.

As can be seen with reference to FIGS. 11, 12 and 13, which depict the same moment in time as FIGS. 5, 6 and 7, the index is 217.5, indicating that the extrapolated score will exceed the 200 point target score. Accordingly, an "over" option that the score will be over 210 has a price of $10.80 (a 380% increase over the $2.80 price at the beginning). However, an "under" option that the score would be under 210 has a price of $4.70 (less than 24% of the original price of $20.00). FIG. 14 and 15 depict exemplary player's screens at the end of the game at which time the options are traded into the host and the winner determined based on which player accumulated the most simulated wealth.

As with the favorite/underdog game, the players attempt to time their buying and selling of options in response to the movement of the simulated market, in order to maximize profits and accumulate the most wealth. At the end of the sporting event, the player that has amassed the most wealth is declared the winner.

For simplicity's sake in the description, the values inputted into the variables for current score, total time, time remaining and other values derived from the sporting event are described as being "equal" to the actual values of those parameters. Obviously, all of the variables are scalable. Therefore, as long as the values derived from the sporting event are proportional to the actual values, the sporting event will provide appropriate basis from which to simulate a market consistent with the present invention. Accordingly, for the purpose of interpreting the claims, where a variable that is inputted is stated as being "equal to" the current score, total time, time remaining, or any other external variable relating to the particular sporting event being used as the basis for simulating the definition also includes "proportional to" that value.

Although certain preferred embodiments and methods have been disclosed herein, it will be apparent from the foregoing disclosure to those skilled in the art that variations and modifications of such embodiments and methods may be made without departing from the true spirit and scope of the invention. For example, consistent with the use of "score" herein meaning any quantifiable indication of the progress of a competition, sporting events that do not have a score in points, but have a winner based on elapsed time, or based on the first to cross a finish line, such as in a sailboat race, may be used to model the market in accordance with the present invention. As discussed with reference to FIGS. 8–13 the market can be modeled based on total points accumulated by both teams rather than the scores of both. Similarly, the market can be modeled based on parameters that do not determine the winner of an event, such as the number of hits or errors in a baseball game. Accordingly, it is intended that the invention shall be limited only to the extent required by the appended claims and the rules and principles of applicable law.

What is claimed is:

1. A sports options trading game that uses a sporting event as a basis for simulating a market and is playable by a plurality of players each having data terminal, said game comprising:

means for allocating to each of said plurality of players a predetermined sum of simulated money displayed as a field on said data terminal;

means for providing an array of simulated commodities options available for purchase, said options being displayed as a plurality of fields on said data terminals;

means responsive to said sporting event for calculating a plurality of intrinsic option prices based on values comprising a plurality of predetermined option strike prices and a current score in said sporting event;

means for displaying said intrinsic option prices on said data terminals;

means for providing each player with an opportunity to buy and sell said options at said intrinsic option prices by inputting information into said data terminal, wherein said players attempt to accumulate the most simulated wealth by buying and selling said options at favorable prices as said prices fluctuate in response to said progress of said sporting event; and means for terminating the game when said sporting event ends and determining a winner of said game.

2. The sports options trading game of claim 1 further including:

means for calculating a time dependent multiplier for said options; and means for adjusting said plurality of intrinsic option prices based on said time dependent multiplier to arrive at a plurality of final option prices.

3. The sports options trading game of claim 2 wherein said sporting event includes a favorite and an underdog participant and wherein said means for calculating said time dependent multiplier for said favorite comprises a computer executable algorithm that is a function of a plurality of sporting event indexed values, said sporting event indexed values comprising an initial point spread, a time remaining figure, and a total time figure, said initial point spread having a value equal to a point spread determined from said preselected sporting event, said total time figure having a value equal to the total time of the preselected sporting event, and said time remaining figure having a value equal to the time remaining in said preselected sporting event.

4. The sports options trading game of claim 3 wherein said sporting event indexed values further include an empirically determined multiplier the value of which is selected based on said intrinsic option prices.

5. The sports options trading game of claim 2 wherein said sporting event includes a favorite and an underdog participant and wherein said means for calculating said time value for said underdog comprises a computer executable algorithm that is a function of a plurality of sporting event indexed values, said sporting event indexed values comprising an initial point spread, a time remaining figure, and a total time figure, said initial point spread having a value equal to a point spread determined from said preselected sporting event, said total time figure having a value equal to the total time of the preselected sporting event, and said time remaining figure having a value equal to the time remaining in said preselected sporting event.

6. The sports options trading game of claim 5 wherein said sporting event indexed values further include an empirically determined multiplier the value of which is selected based on said intrinsic option prices.

7. The sports options trading game of claim 1 wherein said score comprises the points scored by a participant in said sporting event.

8. The sports options trading game of claim 1 wherein said score comprises an aggregate of points scored by all participants in said sporting event.

9. The sports options trading game of claim 1 wherein said sporting event comprises a basketball game and said incidents in said sporting event comprise a current score, the total length of time in a basketball game for regulation play and the time remaining in regulation play.

10. The sports options trading game of claim 1 wherein said sporting event comprises a football game and said incidents in said sporting event comprise a current score, the total length of time in a football game for regulation play and the time remaining in regulation play.

11. The sports options trading game of claim 1 wherein said sporting event comprises a baseball game and said incidents in said sporting event comprise a current score, the total number of innings in a baseball game for regulation play and the number of innings remaining in regulation play.

12. The sports options trading game of claim 1 wherein said sporting event comprises a sailboat regatta and said incidents in said sporting event comprise the lead time held by the leading boat, the total number of buoys to be rounded in a regulation race and the number of buoys to be rounded in a race.

13. The sports options trading game of claim 1 wherein said sporting event comprises a golf game and said incidents in said sporting event comprise the number of strokes for a predetermined golfer and the number of holes left to play.

14. The sports options trading game of claim 2 wherein said score comprises the points scored by a participant in said sporting event.

15. The sports options trading game of claim 2 wherein said score comprises an aggregate of points scored by all participants in said sporting event.

16. The sports options trading game of claim 2 wherein said sporting event comprises a basketball game and said incidents in said sporting event comprise a current score, the total length of time in a basketball game for regulation play and the time remaining in regulation play.

17. The sports options trading game of claim 2 wherein said sporting event comprises a football game and said incidents in said sporting event comprise a current score, the total length of time in a football game for regulation play and the time remaining in regulation play.

18. The sports options trading game of claim 2 wherein said sporting event comprises a baseball game and said incidents in said sporting event comprise a current score, the total number of innings in a baseball game for regulation play and the number of innings remaining in regulation play.

19. A method of playing an options trading game using a sporting event as a basis for simulating a market and playable by a plurality of players each having data terminal, said method comprising:

allocating to each of said plurality of players a predetermined sum of simulated money displayed as a field on said data terminal;

providing an array of options available for purchase, said options being displayed as a plurality of fields on said data terminals;

inputting into a host computer a plurality of option strike prices each having a predetermined value;

inputting a score into said host computer, said score having a value equal to a current score in a preselected sporting event;

calculating a plurality of intrinsic option prices based on values comprising said plurality of predetermined option strike prices and said current score in said sporting event, said option prices being displayed as a plurality of fields on said data terminals corresponding to said options available for purchase;

providing each player with an opportunity to buy and sell said options at said option prices by inputting information into said data terminal, wherein said players attempt to accumulate the most simulated wealth by buying and selling said options at favorable prices as said prices fluctuate in response to said sporting event;

terminating the game when said preselected sporting event ends.

20. The method of claim 19 further including:

calculating a time dependent multiplier for said options; and adjusting said plurality of intrinsic option prices based on said time dependent multiplier to arrive at a plurality of final option prices.

* * * * *